US008020958B2

(12) United States Patent
Murashima

(10) Patent No.: US 8,020,958 B2
(45) Date of Patent: Sep. 20, 2011

(54) RECORDING APPARATUS

(75) Inventor: Hiroshi Murashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 386 days.

(21) Appl. No.: 11/776,290

(22) Filed: Jul. 11, 2007

(65) Prior Publication Data

US 2008/0012891 A1 Jan. 17, 2008

(30) Foreign Application Priority Data

Jul. 12, 2006 (JP) ..... 2006-191957

(51) Int. Cl.
*B41J 29/38* (2006.01)

(52) U.S. Cl. ..... 347/16; 347/104; 399/43

(58) Field of Classification Search ..... 347/16
See application file for complete search history.

(56) References Cited

U.S. PATENT DOCUMENTS

| | | | | |
|---|---|---|---|---|
| 5,189,470 | A * | 2/1993 | Matsuda et al. | 399/68 |
| 5,349,905 | A | 9/1994 | Taylor et al. | |
| 6,393,244 | B1 * | 5/2002 | Nakayasu et al. | 399/301 |
| 6,834,174 | B2 * | 12/2004 | Imaizumi et al. | 399/162 |
| 2003/0158615 | A1 * | 8/2003 | Weber et al. | 700/96 |
| 2005/0253329 | A1 * | 11/2005 | Morisaki et al. | 271/270 |
| 2006/0098074 | A1 | 5/2006 | Nakashima | |
| 2009/0220258 | A1 * | 9/2009 | Takiguchi | 399/43 |

FOREIGN PATENT DOCUMENTS

| | | | |
|---|---|---|---|
| EP | 1655141 | A2 | 5/2006 |
| JP | H07-325462 | A | 12/1995 |
| JP | 09319282 | A * | 12/1997 |
| JP | 2001-356616 | A | 12/2001 |
| JP | 2004-145086 | A1 | 5/2004 |
| JP | 2004145086 | * | 5/2004 |
| JP | 2005-003818 | A1 | 1/2005 |
| JP | 2005003818 | * | 1/2005 |
| JP | 2006-131353 | A | 5/2005 |

OTHER PUBLICATIONS

European Patent Office, European Search Report mailed Oct. 30, 2007 for Related Application No. EP 07252780.

The State Intellectual Property Office of the People's Republic of China, Notification of the Second Office Action for Chinese Patent Application No. 200710129104.2 (counterpart to above-captioned patent application), dated Aug. 11, 2010.

* cited by examiner

*Primary Examiner* — Matthew Luu
*Assistant Examiner* — Shelby Fidler
(74) *Attorney, Agent, or Firm* — Baker Botts L.L.P.

(57) ABSTRACT

A recording apparatus includes a conveyor mechanism, a placer, a recording head, and a controller that controls the conveyor mechanism, the placer, and the recording head. The controller determines a desired speed, which is a desired value of a driving speed of a conveyor belt of the conveyor mechanism during a recording, to be either one of a predetermined first speed and a second speed lower than the first speed. The controller determines the desired speed for a first recording medium to be recorded based on a record command, to be the second speed.

12 Claims, 12 Drawing Sheets

FIG. 9

| CONTINUOUS PRINTING NUMBER k | DESIRED SPEED (rpm) | |
|---|---|---|
| 1 | 10 | |
| 2 | 20 | |
| 3 | 30 | (V2) |
| 4 | 40 | |
| 5 | 50 | |
| EQUAL TO OR GREATER THAN 6 | 60 | (V1) |

RECORDING APPARATUS

CROSS REFERENCE TO RELATED APPLICATION

This application claims priority from Japanese Patent Application No. 2006-191957, which was filed on Jul. 12, 2006, the disclosure of which is herein incorporated by reference in its entirety.

BACKGROUND OF THE INVENTION

1. Field of the Invention

The present invention relates to a recording apparatus that records an image on a recording medium.

2. Description of Related Art

As an ink-jet printer that records an image on a recording medium such as a paper by ejecting ink droplets on the recording medium, one having a conveyor mechanism is known (see Japanese Unexamined Patent Publication No. 2006-131353). The conveyor mechanism includes two rollers and an endless conveyor belt stretched between the rollers, and drives the conveyor belt via the rollers so that a recording medium placed on the conveyor belt is conveyed.

SUMMARY OF THE INVENTION

In an ink-jet printer, because of a demand for a higher printing speed, an attempt has been made to convey a recording medium at a higher speed, that is, to drive a conveyor belt at a higher speed. However, the higher a desired value of a driving speed of the conveyor belt during a printing is set, the more time it takes for the driving speed of the conveyor belt to reach the desired value. As a consequence, a period of time from when the conveyor belt starts driving in response to a print command to when a recording medium is placed onto the conveyor belt is elongated, so that a printing speed sensed by a user is lowered.

An object of the present invention is to provide a recording apparatus that improves a recording speed sensed by a user.

According to an aspect of the present invention, there is provided a recording apparatus comprising a conveyor mechanism, a placer, a recording head, and a controller. The conveyor mechanism includes a plurality of rollers, an endless conveyor belt that is stretched between the rollers and has an outer circumferential surface for a recording medium to be placed thereon, and a driver that drives the conveyor belt. The placer places the recording medium onto the outer circumferential surface of the conveyor belt. The recording head records an image on the recording medium being conveyed by the conveyor mechanism. The controller controls the conveyor mechanism, the placer, and the recording head. The controller determines a desired speed, which is a desired value of a driving speed of the conveyor belt during a recording, to be either one of a predetermined first speed and a second speed lower than the first speed. The controller controls the conveyor mechanism so as to make the conveyor belt start driving and drive constantly at the desired speed, controls the placer so as to make the recording medium placed onto the outer circumferential surface of the conveyor belt after a driving speed of the conveyor belt reaches the desired speed, and controls the recording head so as to make an image recorded on the recording medium while the recording medium is being conveyed by the conveyor belt driven constantly at the desired speed. The controller determines the desired speed for a first recording medium to be recorded based on a record command, to be the second speed.

In the aspect, the controller determines the desired speed to be either one of the first and second speeds. The desired speed for the first recording medium to be recorded based on a record command is determined to be the second speed. This shortens a period of time from when the conveyor belt starts driving in response to a record command to when a recording medium is placed onto the conveyor belt, so that a recording speed sensed by a user is improved, as compared with determining the desired speed for the first recording medium to be the first speed.

BRIEF DESCRIPTION OF THE DRAWINGS

Other and further objects, features and advantages of the invention will appear more fully from the following description taken in connection with the accompanying drawings in which:

FIG. 9 schematically illustrates a table stored in a table memory;

DESCRIPTION OF THE PREFERRED EMBODIMENTS

In the following, some preferred embodiments of the present invention will be described with reference to the accompanying drawings.

Figure 1:
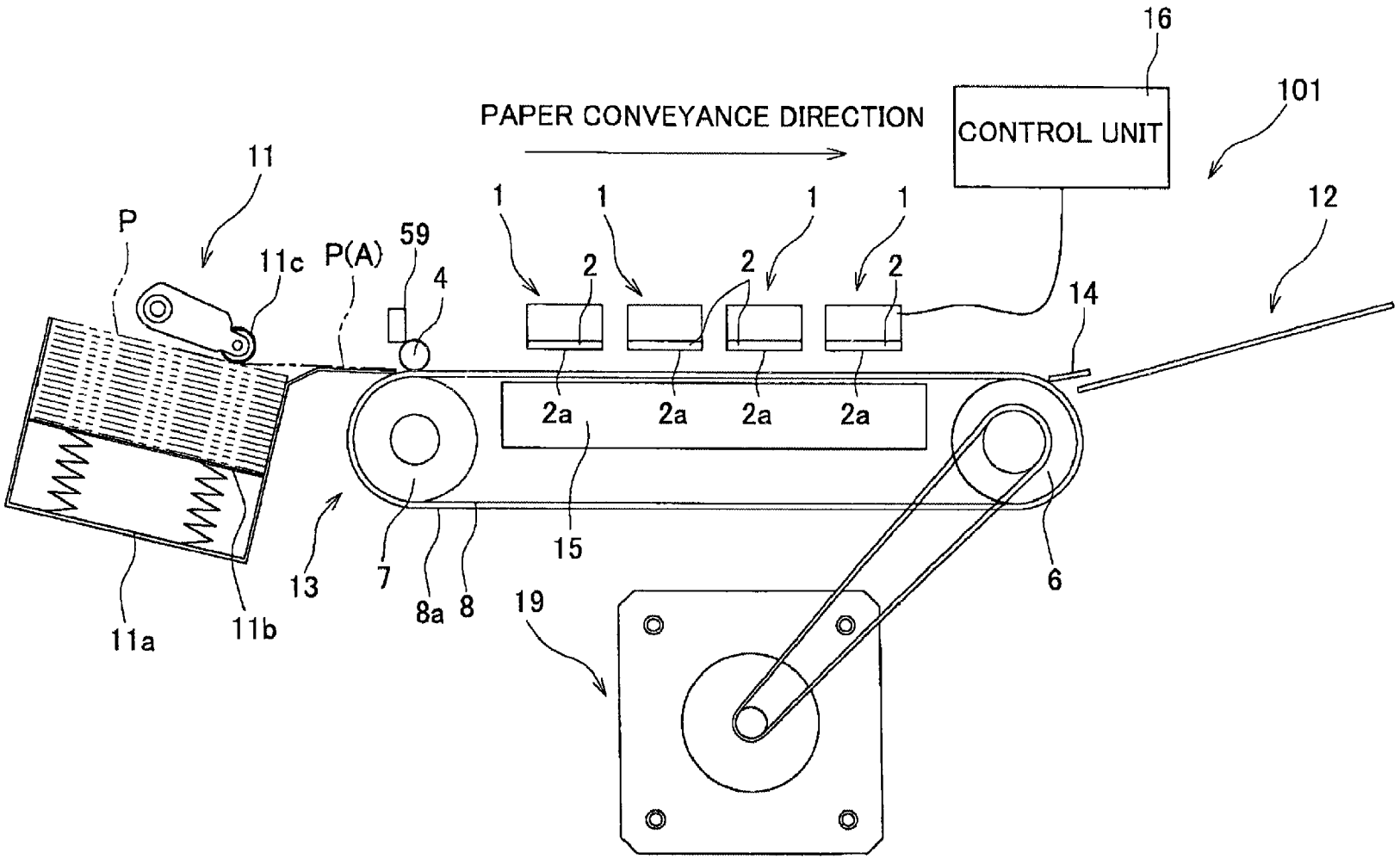
FIG. 1 schematically illustrates a side view of an ink-jet printer according to a first embodiment of the present invention.

FIG. 1 schematically illustrates a side view of an ink-jet printer 101 according to a first embodiment of the present invention. The ink-jet printer 101 is a color ink-jet printer having four ink-jet heads 1. The ink-jet printer 101 has a control unit 16 that controls a total operation of the ink-jet printer 101. The ink-jet printer 101 includes a paper feed unit 11 and a paper discharge tray 12, which are shown in left and right of FIG. 1, respectively.

Formed within the ink-jet printer 101 is a path through which a paper P is conveyed from the paper feed unit 11 toward the paper discharge tray 12. The paper feed unit 11 has a paper stocker 11*a* and a pick-up roller 11*c*. The paper stocker 11*a* has a box-like shape with an opening formed in an upper portion thereof. The paper stocker 11*a* is disposed in such a manner that it is inclined rightward in FIG. 1, that is, toward a downstream in a paper conveyance direction. A supporting plate 11*b* is disposed within the paper stocker 11*a*. The supporting plate 11*b* is biased from a bottom to the opening of the paper stocker 11*a*. A pile of papers P is placed on the supporting plate 11*b*. The pick-up roller 11*c*, which is driven by a placement motor 11*d* (see FIG. 2), picks up upper one of the papers P stacked in the paper stocker 11*a*, and sends out the picked-up paper P toward the downstream in the conveyance direction. A paper sensor 59 is disposed immediately downstream of the paper feed unit 11. The paper sensor 59 detects whether a paper P sent out by the pick-up roller 11*c* has reached a printing standby position A or not. The printing standby position A locates immediately upstream of the conveyor belt 8. The paper sensor 59 is adjusted so as to detect a leading edge of a paper P located at the printing standby position A. The paper P sent out of the paper stocker 11*a* by the pick-up roller 11*c* passes through the printing standby position A, and is placed onto an outer circumferential surface 8*a* of the conveyor belt 8.

A conveyor mechanism 13 is provided in a middle of the paper conveyance path. The conveyor mechanism 13 includes two belt rollers 6 and 7, an endless conveyor belt 8, a conveyor motor 19, and a platen 15. The conveyor belt 8 is wound on the rollers 6 and 7 so as to be stretched between the rollers 6 and 7. The conveyor motor 19 makes the belt roller 6 rotate. The platen 15 is disposed in a region enclosed by the conveyor belt 8, so as to be opposed to the ink-jet heads 1. The platen 15 supports the conveyor belt 8 to prevent a portion of the conveyor belt 8 opposed to the ink-jet heads 1 from being bent downward. A nip roller 4 is disposed at a position opposed to the belt roller 7. When a paper P is placed onto the outer circumferential surface 8*a* of the conveyor belt 8 by the pick-up roller 11*c*, then the nip roller 4 presses the paper P to the outer circumferential surface 8*a*. When the conveyor motor 19 makes the belt roller 6 rotate, the conveyor belt 8 is driven. The conveyor belt 8 thereby conveys the paper P, which has been pressed onto the outer circumferential surface 8*a* by the nip roller 4, toward the paper discharge tray 12 while keeping the paper P by its adhesive force.

A peeling plate 14 is provided immediately downstream of the conveyor belt 8. The peeling plate 14 peels a paper P, which has been kept on the outer circumferential surface 8*a* of the conveyor belt 8, from the outer circumferential surface 8*a*, and then sends the paper P to the paper discharge tray 12.

The four ink-jet heads 1, which correspond to four colors of ink, namely, magenta ink, yellow ink, cyan ink, and black ink, respectively, are arranged side by side in the conveyance direction of the paper P. Each of the ink-jet heads 1 is fixed in such a manner that it spans the paper P with respect to a direction perpendicular to the conveyance direction, that is, with respect to a direction perpendicularly crossing the drawing sheet of FIG. 1. Thus, the ink-jet printer 101 is a line-type printer. Each ink-jet head 1 has, at its lower end, a head main body 2 of rectangular parallelepiped shape elongated in the direction perpendicular to the conveyance direction, that is, elongated in the direction perpendicularly crossing the drawing sheet in FIG. 1. A bottom face of the head main body 2 serves as an ink ejection face 2*a* that is opposed to the outer circumferential surface 8*a* of the conveyor belt 8. While a paper P conveyed on the conveyor belt 8 is sequentially passing just under the four head main bodies 2, ink droplets of the respective colors are ejected from the ink ejection face 2*a* toward an upper face of the paper P based on a command from the control unit 16, so that a desired color image is formed on the paper P.

Figure 2:
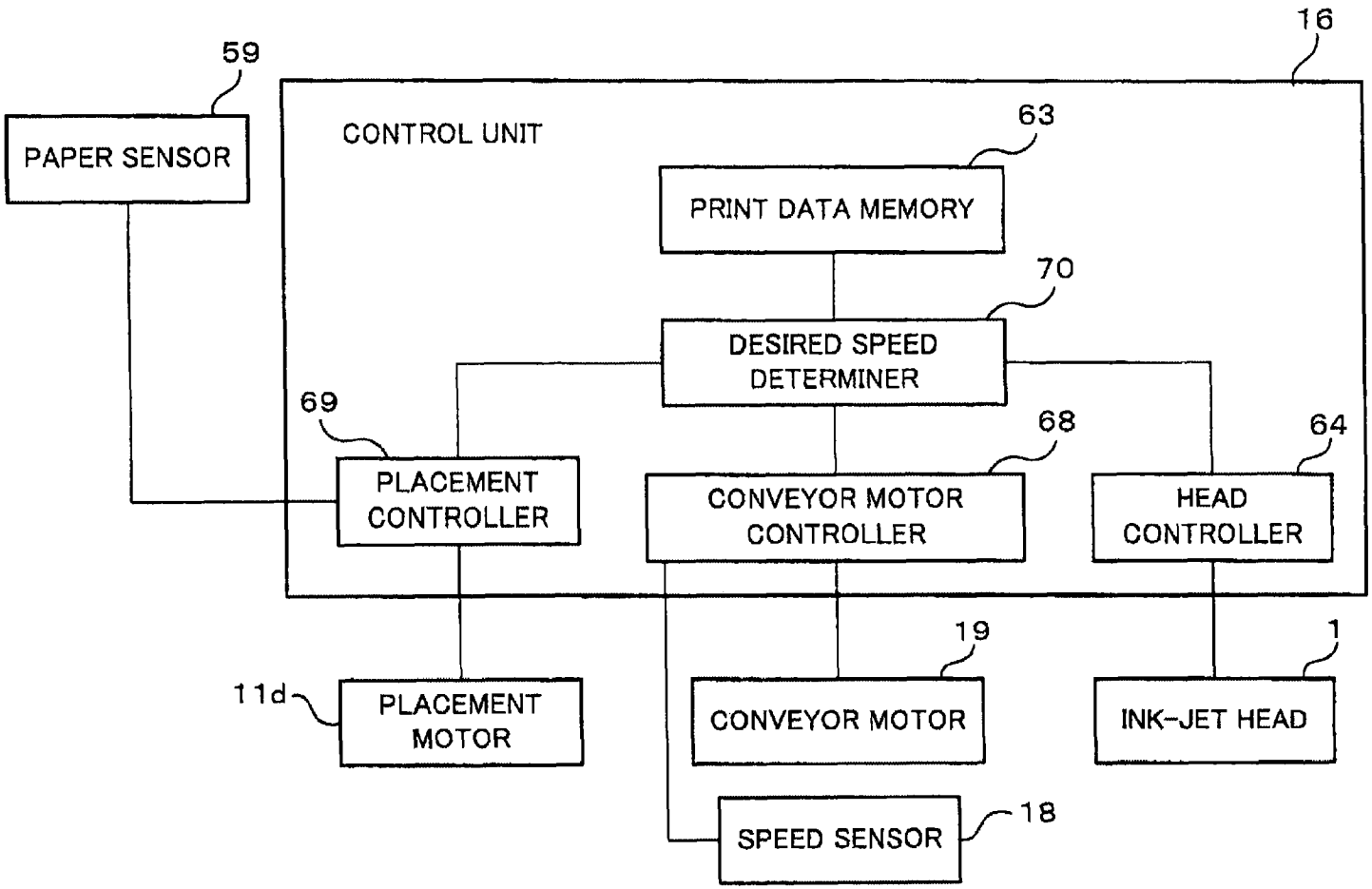
FIG. 2 is a block diagram showing an electrical construction of the ink-jet printer according to the first embodiment of the present invention.

Next, an electrical construction of the ink-jet printer 101 will be described in detail with reference to FIG. 2. FIG. 2 schematically illustrates only one of the four ink-jet heads 1. The control unit 16 has a print data memory 63, a desired speed determiner 70, a head controller 64, a conveyor motor controller 68, and a placement controller 69.

Stored in the print data memory 63 are a print command transferred from a host computer (not shown), a predetermined number m set by a user, and the like. Here, the number m represents an integer equal to or greater than 2. One print command includes a printing number n which means the number of papers P to be continuously printed based on this print command, and image data relating to images to be formed on the respective papers P. Here, the number n represents a positive integer.

Hereinafter, continuously performing a printing on a plurality of papers P based on one print command or based on two or more print commands continuously transmitted without lowering a driving speed of the conveyor belt 8 nor stopping the conveyor belt 8, will be called as a "continuous printing". There are two cases of the continuous printing, namely, a case (A) where a printing number n which is the number of papers P to be continuously printed based on one print command is a plural number, and a case (B) where a next print command is received before completing a printing in response to one print command so that a printing on a plurality of papers P occurs based on these two print commands.

The desired speed determiner 70 determines, for every paper P, a desired speed, which is a desired value of a driving speed of the conveyor belt 8 during a printing. In this embodiment, when a continuous printing is performed, the desired speed determiner 70 determines the desired speed for the first to m-th papers P to be a speed lower than a normal speed, and determines the desired speed for the (m+1)th and subsequent papers P, to be the normal speed, except that a print command including a printing number n greater than q (which represents a predetermined positive integer) is received at a time point when a continuous printing completion number (which means the number of papers P already printed until now since the continuous printing was started) is smaller than m. Hereinafter, the speed lower than the normal speed will be referred to simply as a "low speed". When the number of papers P to be continuously printed, that is, a continuous printing number is equal to or smaller than m, the desired speed is determined to be the low speed for all of the papers P to be continuously printed, except that a print command including a printing number n greater than q is received at a time point when the continuous printing completion number is smaller than m. Here, m is a variable number arbitrarily set by a user within such a range that a low-speed printing time X2 is shorter than a normal-speed printing time X1, as will be detailed later. The normal speed means the maximum driving speed of the conveyor belt 8. In this embodiment, the normal speed corresponds to a rotational speed of the conveyor belt 8 being 60 rpm (revolutions per minute).

The head controller 64 controls the head main body 2 of the ink-jet head 1. More specifically, while the conveyor belt 8 constantly drives at a desired speed determined by the desired speed determiner 70, the head controller 64 controls ejection of ink droplets from the head main bodies 2 so as to form an image on a paper P being conveyed by the conveyor belt 8.

The conveyor motor controller 68 is connected to the conveyor motor 19 and a speed sensor 18 that detects a driving speed of the conveyor belt 8. The conveyor motor controller 68 refers to a driving speed of the conveyor belt 8 detected by the speed sensor 18, and controls the conveyor motor 19 so as to make the conveyor belt 8 constantly drive at a desired speed determined by the desired speed determiner 70.

The placement controller 69 controls the placement motor 11*d* to thereby control driving of the pick-up roller 11*c*. Based on an output result from the paper sensor 59, the placement controller 69 determines whether a paper P sent out by the pick-up roller 11*c* has reached the printing standby position A (see FIG. 1) or not. When the paper P has reached the printing standby position A, the placement controller 69 once stops driving of the pick-up roller 11*c*. Then, at a predetermined timing after the conveyor belt 8 drives constantly at a desired speed determined by the desired speed determiner 70, the placement controller 69 makes a paper P placed onto the outer circumferential surface 8*a* of the conveyor belt 8.

Next, a print control executed by the control unit 16 will be described with reference to FIGS. 3, 4, and 5.

Figure 3:
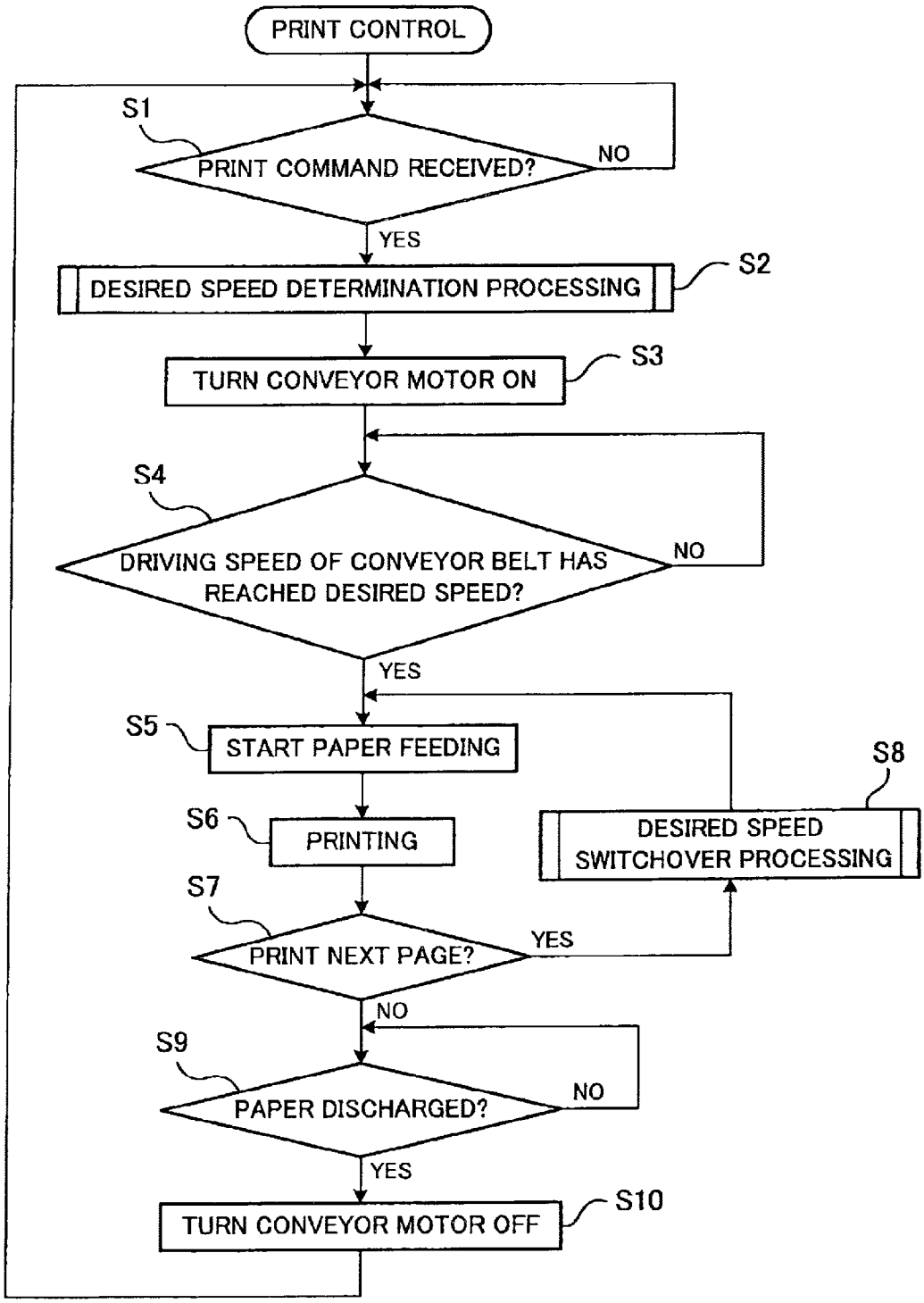
FIG. 3 is a flowchart showing a print control.

First, as shown in FIG. 3, the control unit 16 determines whether a print command is received from a host computer (not shown) or not (S1). When a print command is not received (S1: NO), the step S1 is repeated. When a print command is received (S1: YES), a desired speed determination processing is performed (S2).

For example, the control unit 16 receives a print command including a printing number n equal to 1 one after another. When the ink-jet printer 101 functions as a facsimile, the control unit 16 may receive one print command including a printing number n equal to or greater than 1 (for example, n=100).

Here, the desired speed determination processing will be described with reference to FIG. 4. First, the desired speed determiner 70 acquires a predetermined number m from the print data memory 63 (S11). Then, in S12, the desired speed determiner 70 calculates a low-speed printing time X2 (see FIG. 6) with respect to each of different low speeds (which in this embodiment correspond to five rotational speeds of the conveyor belt 8, namely, 10, 20, 30, 40, and 50 rpm). The low-speed printing time X2 means a period of time required for completing a continuous printing on the first to m-th papers P in a state where the desired speed is a low speed.

Figure 6:
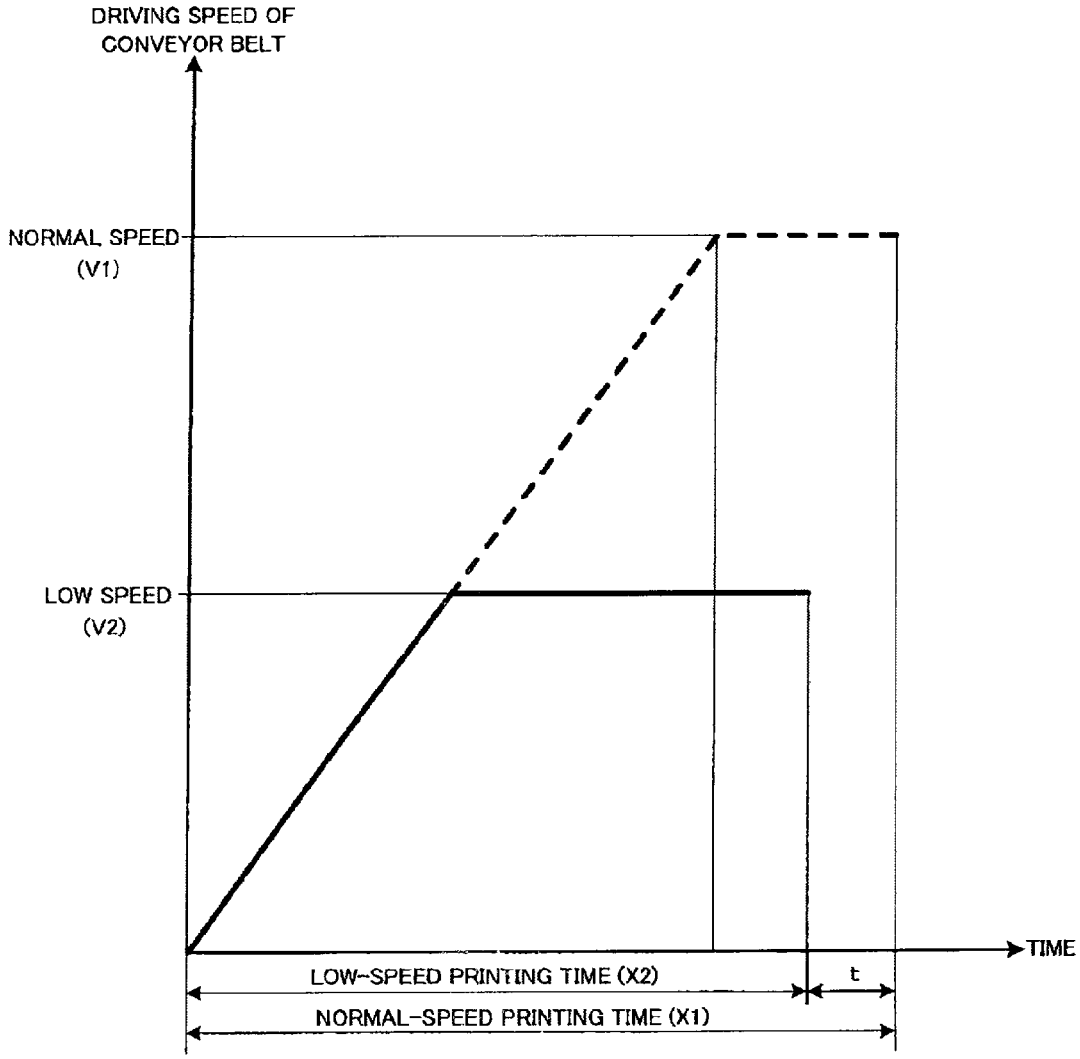
FIG. 6 is a graph showing how a driving speed of a conveyor belt changes over time during a low-speed printing and a normal-speed printing.

FIG. 6 is a graph showing how a driving speed of the conveyor belt 8 changes over time during a low-speed printing and a normal-speed printing. In FIG. 6, an axis of ordinate represents a driving speed of the conveyor belt 8, and an axis of abscissa represents time. A driving speed of the conveyor belt 8 during a low-speed printing is illustrated with a solid line, whereas a driving speed of the conveyor belt 8 during a normal-speed printing is illustrated with a broken line. The low-speed printing time X2 is a sum of a period of time from when the conveyor belt 8 starts driving to when a driving speed of the conveyor belt 8 reaches a low speed V2 and a period of time from when the first paper P is placed onto the outer circumferential surface 8*a* of the conveyor belt 8 after the driving speed of the conveyor belt 8 reaches the low speed V2 to when a printing on the m-th paper P is completed. The low-speed printing time X2 is shorter than the normal-speed printing time X1 by a time length t. The normal-speed printing time X1 means a period of time required for completing a continuous printing on the first to m-th papers P in a state where the desired speed is the normal speed V1. The normal-speed printing time X1 is a sum of a period of time from when the conveyor belt 8 starts driving to when a driving speed of the conveyor belt 8 reaches the normal speed V1 and a period of time from when the first paper P is placed onto the outer circumferential surface 8*a* of the conveyor belt 8 after the driving speed of the conveyor belt 8 reaches the normal speed V1 to when a printing on the m-th paper P is completed.

Referring back to FIG. 4, the step S12 is followed by the step S13 in which the desired speed determiner 70 determines the desired speed to be a low speed V2 that corresponds to the shortest one of the low-speed printing times X2 calculated in S12. Thus, any one of the five rotational speeds of the conveyor belt 8, namely, 10, 20, 30, 40, and 50 rpm is selected.

Then, referring back to FIG. 3, the conveyor motor controller 68 starts driving the conveyor motor 19 (S3). Then, based on a detection signal from the speed sensor 18, the conveyor motor controller 68 determines whether a driving speed of the conveyor belt 8 has reached the desired speed determined in S2 or not (S4). When a driving speed of the conveyor belt 8 has reached the desired speed (S4: YES), the conveyor motor controller 68 controls the conveyor motor 19 so as to drive the conveyor belt 8 constantly at the desired speed. Then, the placement controller 69 controls the placement motor 11*d*, to place a paper P onto the outer circumferential surface 8*a* of the conveyor belt 8. That is, papers start to be fed (S5). the head controller 64 controls the head main bodies 2 of the ink-jet heads 1, so that an image is formed on one paper P being conveyed by the conveyor belt 8 (S6).

After a printing on one paper P is completed, the control unit 16 determines whether a next page printing is necessary or not (S7). At this time, the control unit 16 refers to a printing number n stored in the print data memory 63. When the number of papers P already printed until now since a printing based on the current print command was started is smaller than n, the control unit 16 determines that a next page printing is necessary. Also when a new print command is received from the host computer (not shown), the control unit 16 also determines that a next page printing is necessary. When a next page printing is necessary (S7: YES), a desired speed switchover processing which will be described later is executed (S8). When a next page printing is not necessary (S7: NO), the control unit 16 determines whether the paper P has been conveyed to the paper discharge tray 12 or not (S9). When the paper P has been conveyed to the paper discharge tray 12 (S9: YES), the conveyor motor controller 68 stops the conveyor motor 19 (S10). Thus, the conveyor belt 8 stops driving. Then, the number of papers P already printed until now since the time point of the step S1, that is, the continuous printing completion number, is reset, and the processing returns to the step S1.

Here, the desired speed switchover processing will be described with reference to FIG. 5. First, whether a current driving speed of the conveyor belt 8 is the normal speed V1 or not is determined (S21). When a driving speed of the conveyor belt 8 is the normal speed V1 (S21: YES), the desired speed switchover processing ends without a switchover of the desired speed, and the processing returns to the step S5 shown in FIG. 3.

When a driving speed of the conveyor belt 8 is not the normal speed V1 (S21: NO), whether the continuous printing completion number is equal to m or not is determined (S22). When the continuous printing completion number is equal to m (S22: YES), the desired speed determiner 70 switches the desired speed from the low speed V2 to the normal speed V1 (S25).

When the continuous printing completion number is not equal to m (S22: NO), then whether a new print command is received from the host computer (not shown) or not is determined (S23). When a new print command is not received (S23: NO), the desired speed switchover processing ends without a switchover of the desired speed, and the processing returns to the step S5 shown in FIG. 3.

When a new print command is received (S23: YES), whether a printing number n included in this new print command is equal to or smaller than q, or not is determined (S24). When the printing number n is equal to or smaller than q (S24: YES), the desired speed switchover processing ends without a switchover of the desired speed, and the processing returns to the step S5 shown in FIG. 3.

When the printing number n is not equal to or smaller than q (S24: NO), the desired speed determiner 70 switches the desired speed from the low speed V2 to the normal speed V1 (S25). Then, the placement controller 69 controls the placement motor 11*d* so as not to place a paper P onto the outer circumferential surface 8*a* of the conveyor belt 8. That is, a paper feeding is temporarily stopped (S26). Then, the conveyor motor controller 68 changes a rotational speed of the conveyor motor 19 to a maximum speed (S27).

After S27, based on a detection signal from the speed sensor 18, the conveyor motor controller 68 determines whether a driving speed of the conveyor belt 8 has reached the normal speed V1, which is the desired speed, or not (S28). When a driving speed of the conveyor belt 8 has reached the normal speed V1 (S28: YES), the desired speed switchover processing ends, and the processing returns to the step S5 shown in FIG. 3.

Figure 4:
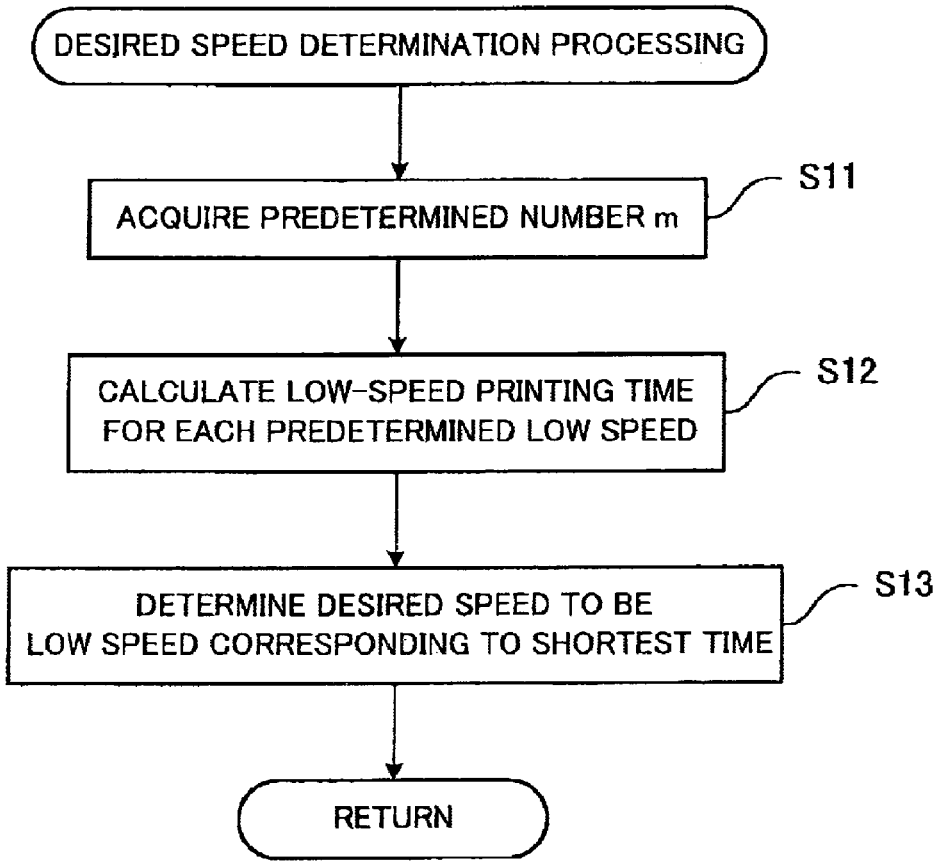
FIG. 4 is a flowchart showing a desired speed determination processing.
Figure 5:
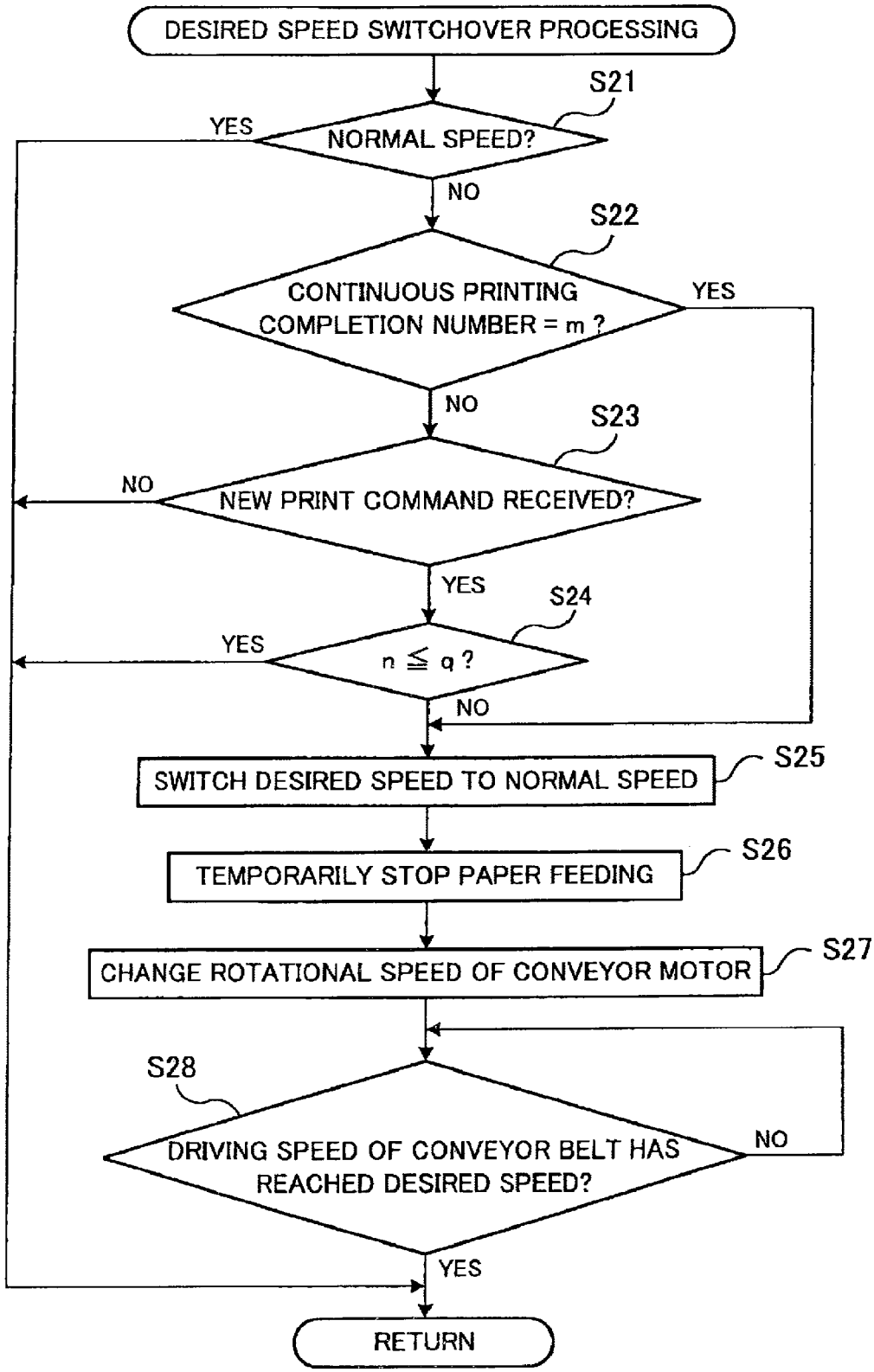
FIG. 5 is a flowchart showing a desired speed switchover processing.

According to the print control shown in FIGS. 3 to 5, when a continuous printing is performed, the desired speed for the first to m-th papers P is determined to be the low speed V2, and the desired speed for the (m+1)th and subsequent papers P is determined to be the normal speed V1 (see FIG. 7), except that a print command including a printing number n greater than q is received at a time point when the continuous printing completion number is smaller than m.

Figure 7:
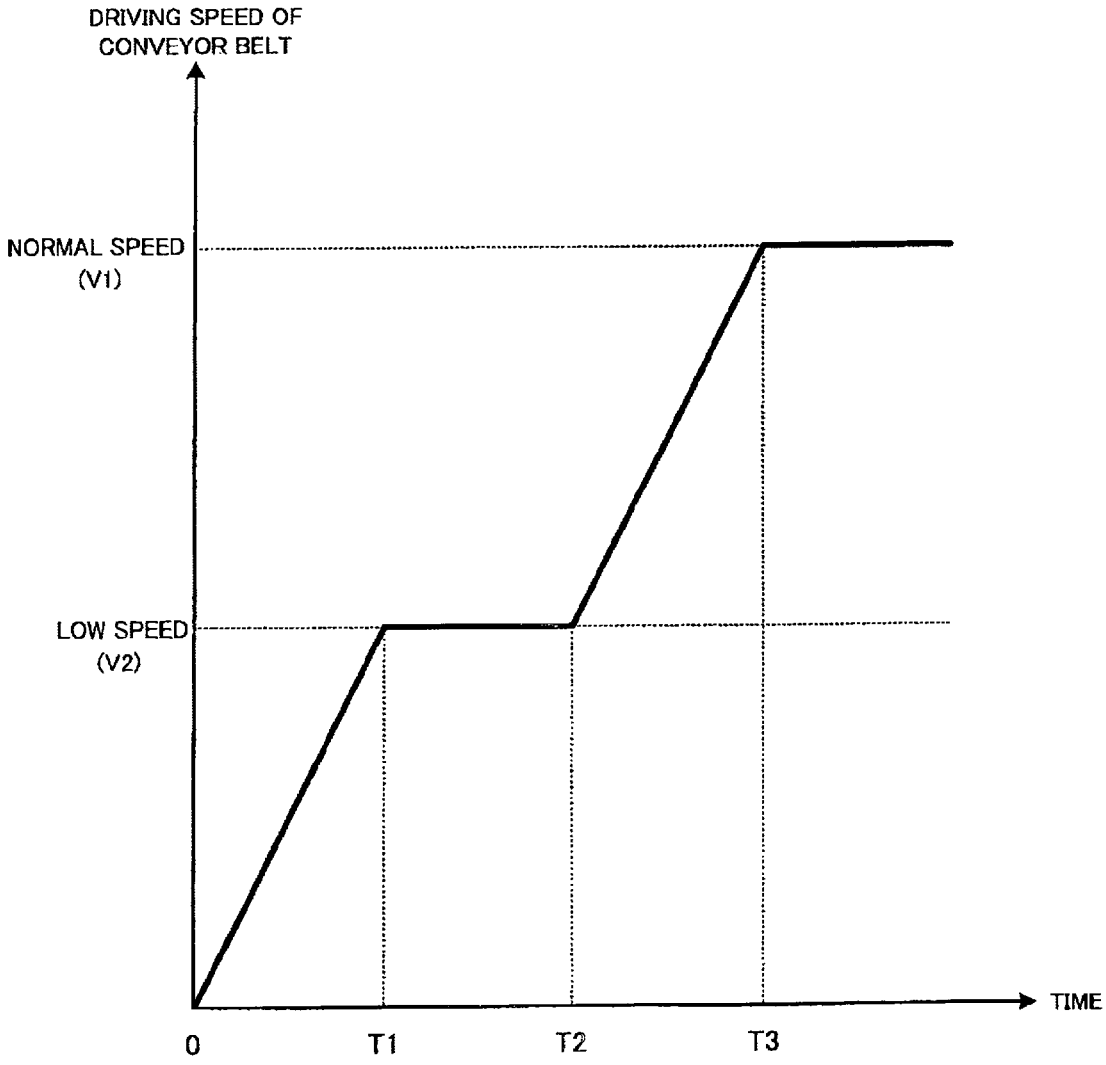
FIG. 7 is a graph showing how a driving speed of the conveyor belt changes over time during a continuous printing.

To be more specific, in performing a continuous printing on the first to m-th papers P, the conveyor motor controller 68 controls the conveyor motor 19 so as to make the conveyor belt 8 start driving and then drive constantly at the low speed V2, as shown in an interval between time points 0 and T2 in FIG. 7. The placement controller 69 controls the placement motor 11*d* in such a manner that the first paper P is placed onto the outer circumferential surface 8*a* of the conveyor belt 8 after a driving speed of the conveyor belt 7 reaches the low speed V2 at a time point T1. The head controller 64 controls the head main bodies 2 in such a manner that an image is formed on a paper P while the paper P is being conveyed by the conveyor belt 8 which is driven constantly at the low speed V2 as shown in an interval between time points T1 and T2 in FIG. 7. In this manner, a low-speed printing is performed on the first to m-th papers P.

In performing a continuous printing on the (m+1)th and subsequent papers P, the conveyor motor controller 68 controls the conveyor motor 19 so as to make the conveyor belt 8 start driving at the low speed V2 and then drive constantly at the normal speed V1 after the low-speed printing on the m-th paper P is completed at the time point T2. The placement controller 69 controls the placement motor 11*d* in such a manner that the (m+1)th paper P is placed onto the outer circumferential surface 8*a* of the conveyor belt 8 after a driving speed of the conveyor belt 8 reaches the normal speed V1 at a time point T3. The head controller 64 controls the head main bodies 2 in such a manner that an image is formed on a paper P while the paper P is being conveyed by the conveyor belt 8 which is driven constantly at the normal speed V1 after the time point T3. In this manner, a normal-speed printing is performed on the (m+1)th and subsequent papers P.

In a case where the continuous printing number is equal to or smaller than m, the desired speed is determined to be the low speed V2 for all of the papers P to be continuously printed, except that a print command including a printing number n greater than q is received at a time point when the continuous printing completion number is smaller than m. In such a case, a section following the time point T2 in FIG. 7 is omitted.

When, in a case where a new print command is received (S23: YES) before completion of a printing at the low speed V2 as the desired speed, the new print command includes a printing number n greater than q (S24: NO), the desired speed is switched from the low speed V2 to the normal speed V1, and a printing based on the new print command is started. In this case, a printing based on the previous print command is completed at the time point T2 in FIG. 7. Then, a driving speed of the conveyor belt 8 becomes higher as a rotational speed of the conveyor motor 19 increases. At the time point T3, the driving speed of the conveyor belt 8 reaches the normal speed V1, and then a first paper P based on the new print command is placed onto the outer circumferential surface 8*a* of the conveyor belt 8.

When, in a case where a new print command is received (S23: YES) before completion of a printing at the low speed V2 as the desired speed, the new print command includes a printing number n equal to or smaller than q (S24: YES), the low speed V2 is maintained as the desired speed and in this condition a printing based on the new print command is started. In such a case, a section following the time point T2 in FIG. 7 is omitted.

As thus far described above, according to this embodiment, the control unit 16 determines the desired speed to be either one of the normal speed V1 and the low speed V2. For first one of papers P to be printed based on a print command, the control unit 16 determines the desired speed to be the low speed V2. This shortens a period of time from when the conveyor belt 8 starts driving in response to a print command to when a paper P is placed onto the conveyor belt 8, so that a printing speed sensed by a user is improved, as compared with determining the desired speed for the first paper P to be the normal speed V1.

When a continuous printing is performed, the desired speed for the first to m-th papers P is determined to be the low speed V2, and the desired speed for the (m+1)th and subsequent papers P is determined to be the normal speed V1. Such a combination of the low-speed printing and the normal-speed printing enables a printing operation to be efficiently performed in a short time.

During a period of time from when a printing on the m-th paper P is completed to when the driving speed of the conveyor belt 8 reaches the normal speed V1 (i.e., during an interval between the time points T2 and T3 in FIG. 7), the conveyor motor controller 68 controls the conveyor motor 19 so as to make the conveyor belt 8 keep driving. This advances a timing of starting a printing on the (m+1)th paper P, so that a printing speed sensed by a user is further improved, as compared with temporarily stopping the conveyor belt 8 after completion of a printing on the m-th paper.

In addition, during a period of time from when a printing on the m-th paper is completed to when the driving speed of the conveyor belt 8 reaches the normal speed V1 (i.e., during an interval between the time points T2 and T3 in FIG. 7), a paper feeding is temporarily stopped (see S26 in FIG. 5). This prevents occurrence of a paper jam and a printing failure during a printing operation.

The low speed V2 is determined in such a manner that the low-speed printing time X2 is shorter than the normal-speed printing time X1 (see FIG. 6). As a result, a time required for a printing is practically shortened, and therefore a printing speed sensed by a user is surely improved.

In this embodiment, moreover, in the desired speed determination processing, a low-speed printing time X2 is calculated with respect to each of different low speeds V2 (S12), and a low speed V2 corresponding to the shortest one of the low-speed printing times X2 thus calculated is determined as the desired speed (S13). Accordingly, a value of the low speed V2 is determined in an efficient manner, so that a time required for a printing is further shortened.

When, in a case where a new print command is received (S23: YES) before completion of a printing at the low speed V2 as the desired speed, the new print command includes a printing number n greater than q (S24: NO), the desired speed is switched from the low speed V2 to the normal speed V1. During a period of time from when a printing based on the previous print command is completed at the time point T2 in FIG. 7 to when the driving speed of the conveyor belt 8 reaches the normal speed V1 at the time point T3 in FIG. 7, the conveyor motor controller 68 controls the conveyor motor 19 so as to make the conveyor belt 8 keep driving. This advances a timing of starting a printing based on a new print command, so that a printing speed sensed by a user is further improved, as compared with temporarily stopping the conveyor belt 8 after completion of a printing based on the previous print command.

During a period of time from when a printing based on the previous print command is completed at the time point T2 in FIG. 7 to when the driving speed of the conveyor belt 8 reaches the normal speed V1 at the time point T3 in FIG. 7, a paper feeding is temporarily stopped (see S26 in FIG. 5). This prevents occurrence of a paper jam and a printing failure in performing a printing based on a new print command.

The ink-jet printer 101 has the speed sensor 18 that detects a driving speed of the conveyor belt 8. By referring to the driving speed of the conveyor belt 8 detected by the speed sensor 18, the conveyor motor controller 68 performs a sure control to make the conveyor belt 8 drive constantly at the desired speed.

After a speed detected by the speed sensor 18 reaches the desired speed (S4: YES), the control unit 16 controls the placement motor 11*d* so as to make a paper P placed onto the outer circumferential surface 8*a* of the conveyor belt 8 in S5. By utilizing the speed sensor 18 in this way, it is surely prevented that a paper P is placed onto the outer circumferential surface 8*a* of the conveyor belt 8 before the driving speed of the conveyor belt 8 reaches the desired speed.

The outer circumferential surface 8*a* of the conveyor belt 8 extends horizontally between the pick-up roller 11*c* and the peeling plate 14. This allows a paper P to be smoothly and efficiently placed onto the outer circumferential surface 8*a* of the conveyor belt 8, conveyed by the conveyor belt 8, and peeled from the outer circumferential surface 8*a* of the conveyor belt 8.

Figure 8:
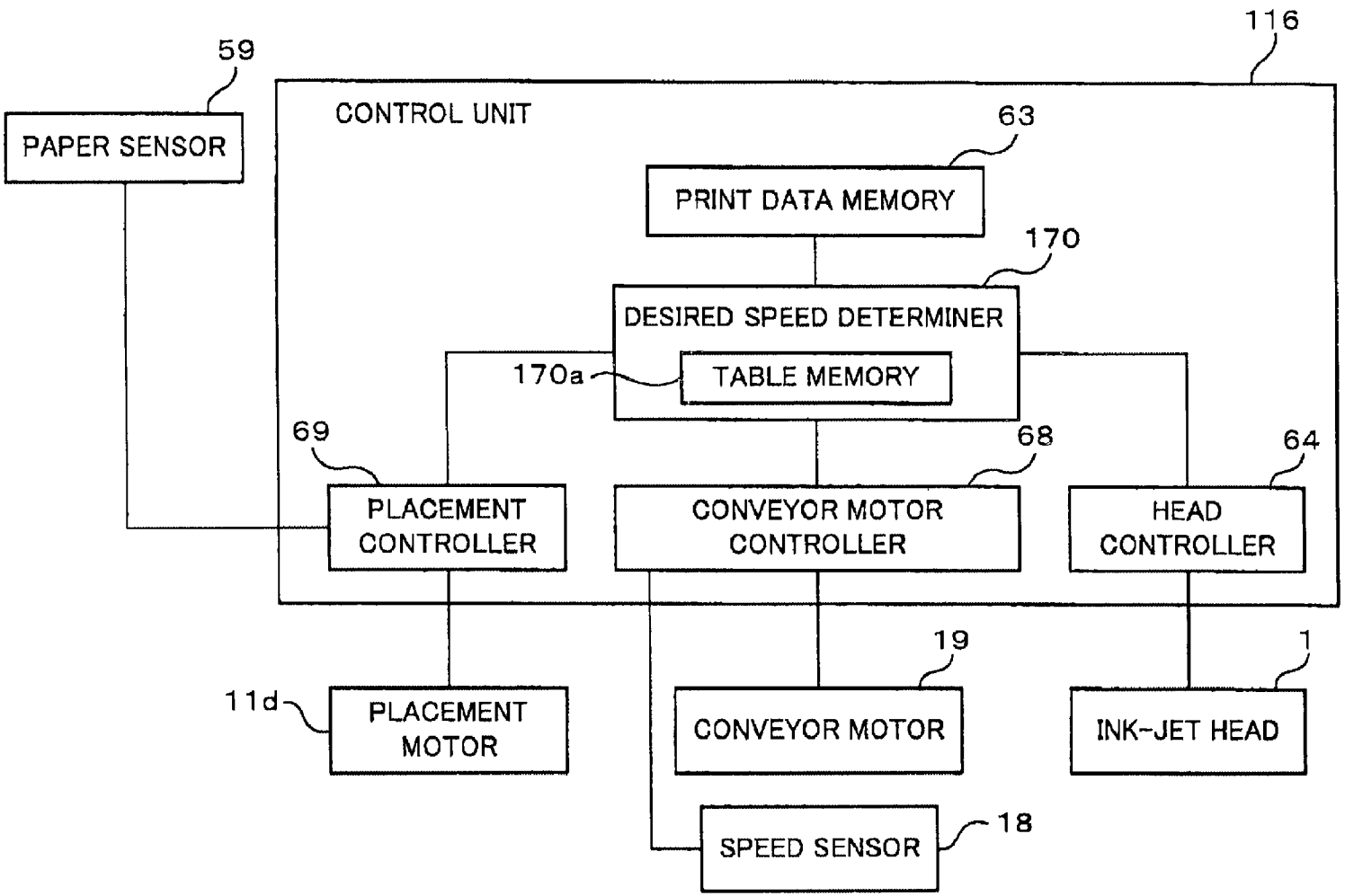
FIG. 8 is a block diagram showing an electrical construction of an ink-jet printer according to a second embodiment of the present invention.

Next, an ink-jet printer according to a second embodiment of the present invention will be described with reference to FIG. 8. Except for a control unit 116, components of an ink-jet printer according to this embodiment are the same as the components of the ink-jet printer according to the first embodiment. Therefore, only the control unit 116 will be described here. The same components as in the first embodiment will be denoted by the same reference numbers, without specific descriptions thereof. FIG. 8 is a block diagram showing an electrical construction of the ink-jet printer according to this embodiment. The control unit 116 has the print data memory 63, a desired speed determiner 170, the head controller 64, the conveyor motor controller 68, and the placement controller 69.

Like the desired speed determiner 70 of the first embodiment, the desired speed determiner 170 determines the desired speed, too. However, the desired speed determiner 170 differs from the desired speed determiner 70 in that it includes a table memory 170*a* storing therein a table shown in FIG. 9. The table represents different continuous printing numbers k and desired speeds corresponding to the respective continuous printing numbers k.

Here, a print control executed by the control unit 116 will be described with reference to FIGS. 10 and 11. In the print control according to this embodiment as well as in the first embodiment, a continuous printing is performed and the continuous printing occurs in both of the cases (A) and (B) described above. The print control of this embodiment is the same as the print control of the first embodiment (see FIG. 3), except for contents of the desired speed determination processing S2 and the desired speed switchover processing S8. Therefore, in the following, a description will be given to contents of the desired speed determination processing S2 and the desired speed switchover processing S8.

Figure 10:
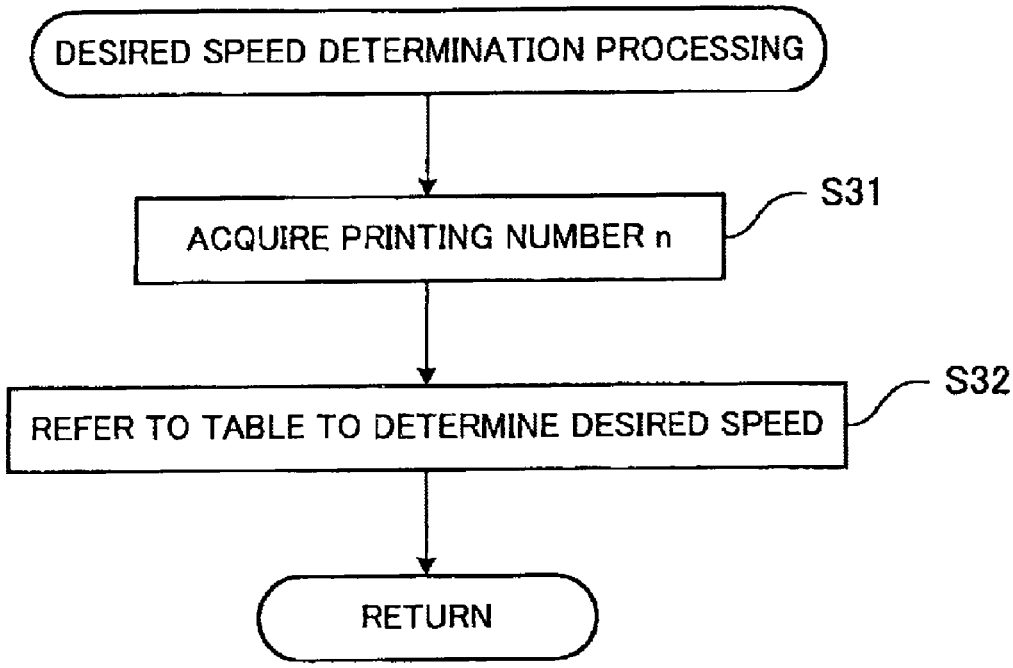
FIG. 10 is a flowchart showing a desired speed determination processing according to the second embodiment.

In the desired speed determination processing of this embodiment, as shown in FIG. 10, the desired speed determiner 170 acquires a printing number n, which is included in a print command received in S1, from the print data memory 63 (S31). Then, in S32, the desired speed determiner 170 refers to the table (see FIG. 9) stored in the table memory 170*a*, and reads the printing number n acquired in S31 as a continuous printing number k, to thereby determine the desired speed (S32). That is, at this time point, the number of papers P to be continuously printed from now on, which means the continuous printing number k, is considered to be equal to the printing number n included in the print command received in S1.

In the table shown in FIG. 9, the desired speed is represented by a rotational speed of the conveyor belt 8, and its unit is rpm. In this embodiment, the predetermined number q is 5. In a case where the continuous printing number k is greater than q+1, that is, equal to or greater than 6, the desired speed is the normal speed V1 (which means a rotational speed of the conveyor belt 8 being 60 rpm). In a case where the continuous printing number k is equal to or smaller than q, that is, equal to or smaller than 5, the desired speed is the low speed V2 (which means a rotational speed of the conveyor belt 8 being 10-50 rpm).

Figure 12:
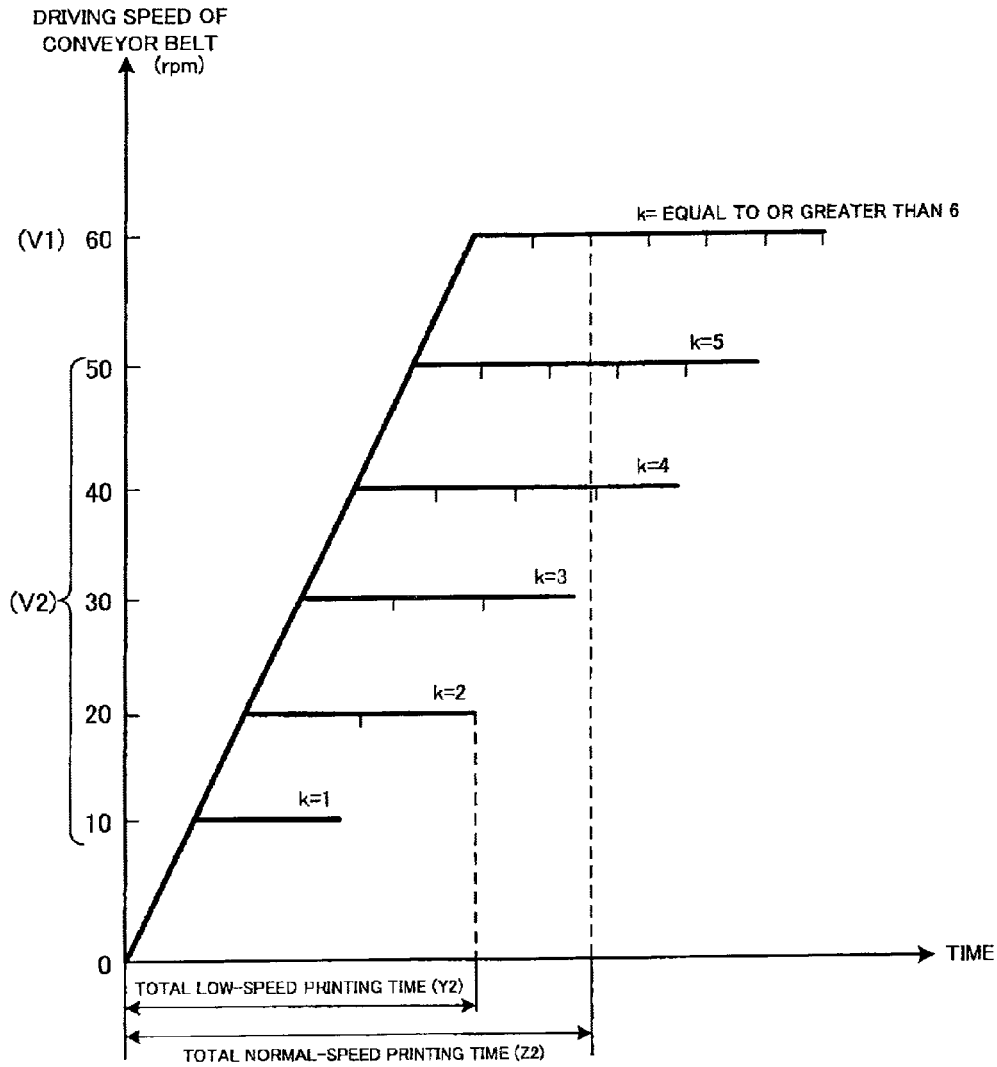
FIG. 12 is a graph showing how a driving speed of a conveyor belt changes over time with respect to each of continuous printing numbers.

The low speed V2 corresponding to each of the continuous printing numbers k=1, 2, 3, 4, and 5 is determined in such a manner that a total low-speed printing time (e.g., a total low-speed printing time Y2 for k=2 in FIG. 12) is shorter than a total normal-speed printing time (e.g., a total normal-speed printing time Z2 for k=2 in FIG. 12). The total low-speed printing time is a period of time required for a continuous printing on the first to k-th papers P at the low speed V2 as the desired speed. The total low-speed printing time is a sum of a period of time from when the conveyor belt 8 starts driving to when a driving speed of the conveyor belt 8 reaches a low speed V2 and a period of time from when the first paper P is placed onto the outer circumferential surface 8*a* of the conveyor belt 8 after the driving speed of the conveyor belt 8 reaches the low speed V2 to when a printing on the k-th paper P is completed. The total normal-speed printing time is a period of time required for a continuous printing on the first to k-th papers P at the normal speed V1 as the desired speed. The total normal-speed printing time is a sum of a period of time from when the conveyor belt 8 starts driving to when a driving speed of the conveyor belt 8 reaches the normal speed V1 and a period of time from when the first paper P is placed onto the outer circumferential surface 8*a* of the conveyor belt 8 after the driving speed of the conveyor belt 8 reaches the normal speed V1 to when a printing on the k-th paper P is completed. FIG. 12 shows that the total low-speed printing time Y2 is shorter than the total normal-speed printing time Z2 with respect to k=2. However, the same applies to k=1, 3, 4, and 5.

Figure 11:
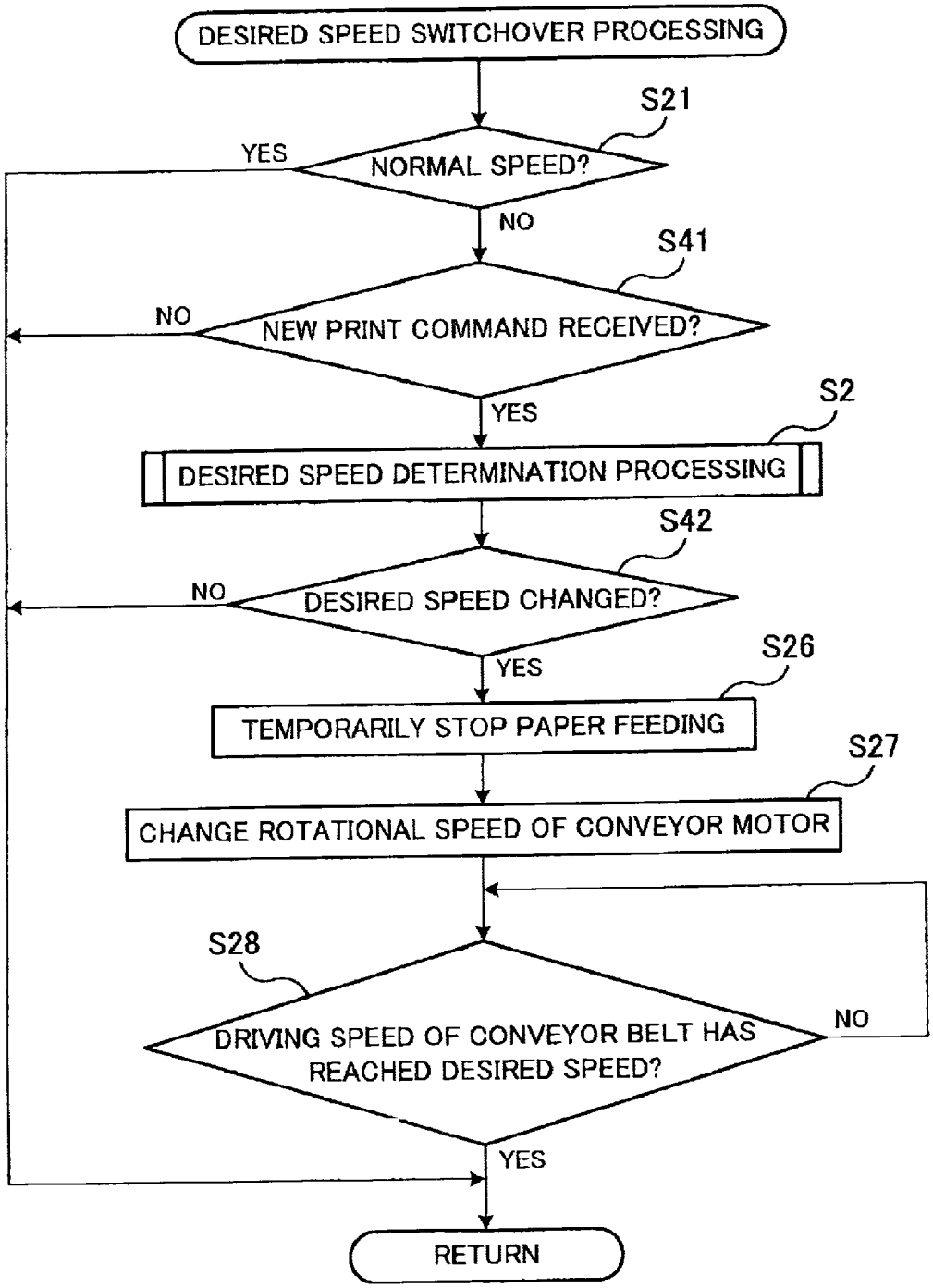
FIG. 11 is a flowchart showing a desired speed switchover processing according to the second embodiment.

In the desired speed switchover processing of this embodiment, as shown in FIG. 11, the same processing as in the step S21 of FIG. 5 is executed to determine whether a current driving speed of the conveyor belt 8 is the normal speed V1 or not (S21). When a driving speed of the conveyor belt 8 is the normal speed V1 (S21: YES), the desired speed switchover processing ends without a switchover of the desired speed, and the processing returns to the step S5 shown in FIG. 3.

When a driving speed of the conveyor belt 8 is not the normal speed V1 (S21: NO), whether a new print command is received from a host computer (not shown) or not is determined (S41). When a new print command is not received (S41: NO), the desired speed switchover processing ends without a switchover of the desired speed, and the processing returns to the step S5 shown in FIG. 3.

When a new print command is received (S41: YES), the desired speed determination processing S2 shown in FIG. 10 is executed. In S2, a printing number n included in the new print command is acquired from the print data memory 63 (S31). Then, a continuous printing number k is calculated by adding the number of unprinted pages involved in the previous print command (that is, the number calculated by subtracting the number of pages already printed from a printing number n included in the previous print command) to the printing number n acquired in S31. The desired speed corresponding to the continuous printing number k is determined with reference to the table (see FIG. 9).

Subsequently, in S42, whether the desired speed has been changed or not is determined. When the desired speed has not been changed (S42: NO), the desired speed switchover processing ends and the processing returns to the step S5 shown in FIG. 3. When the desired speed has been changed (S42: YES), a paper feeding is temporarily stopped (S26). Then, the conveyor motor controller 68 changes a rotational speed of the conveyor motor 19 (S27), and determines whether a driving speed of the conveyor belt 8 has reached the desired speed or not based on a detection signal from the speed sensor 18 (S28). Then, the processing returns to the step S5 shown in FIG. 3.

In the print control according to this embodiment, as shown in FIG. 12, in a case where the continuous printing number k is equal to or greater than q+1, that is, equal to or greater than 6, the desired speed for all the first to k-th papers P is determined to be the normal speed V1 (which means a rotational speed of the conveyor belt 8 being 60 rpm), while in a case where the continuous printing number k is equal to or smaller than q, that is, equal to or smaller than 5, the desired speed for all the first to k-th papers P is determined to be the low speed V2 (which means a rotational speed of the conveyor belt 8 being 10-50 rpm). When the continuous printing number k is equal to or smaller than 5, the desired speed becomes higher as the continuous printing number k increases.

As thus far described above, according to this embodiment, the control unit 116 determines the desired speed to be either one of the normal speed V1 and the low speed V2, like in the above-described first embodiment. In this embodiment, in the case where the continuous printing number k is equal to or smaller than q, that is, equal to or smaller than 5, the desired speed for the first paper P is determined to be the low speed V2. This shortens a period of time from when the conveyor belt 8 starts driving in response to a print command to when a paper P is placed onto the conveyor belt 8, so that a printing speed sensed by a user is improved, which is the same effect as in the first embodiment.

Moreover, in the case where the continuous printing number k is equal to or smaller than q, that is, equal to or smaller than 5, the desired speed for all the first to k-th papers P is determined to be the low speed V2. As a result, no switchover of the desired speed occurs during a continuous printing. This simplifies the control and at the same time improves a printing speed sensed by a user.

Values of the respective low speeds V2, which are determined as the desired speed in the case where the continuous printing number k is equal to or smaller than q, that is, equal to or smaller than 5, are determined in such a manner that the total low-speed printing time is shorter than the total normal-speed printing time (see FIG. 12). As a result, when the continuous printing number k is equal to or smaller than q, that is, equal to or smaller than 5, a time required for a printing is practically shortened and therefore a printing speed sensed by a user is surely improved.

The ink-jet printer according to this embodiment includes the table memory 170*a*. Stored in the table memory 170*a* is the table representing different continuous printing numbers k and desired speeds corresponding to the respective continuous printing numbers k (see FIG. 9). As a result, by referring to the table stored in the table memory 170*a*, the desired speed determiner 170 quickly determines the desired speed corresponding to a continuous printing number k.

In a case where a new print command is received before a printing at the low speed V2 as the desired speed is completed (S41: YES), a sum of a printing number n included in the new print command and the number of unprinted papers P involved in the previous print command is calculated as a continuous printing number k. When the continuous printing number k is greater than q, the desired speed is switched from the low speed V2 to the normal speed V1. During a period of time from when the new print command is received at the time point T2 in FIG. 7 to when the driving speed of the conveyor belt 8 reaches the normal speed V1 at the time point T3 in FIG. 7, the conveyor motor controller 68 controls the conveyor motor 19 so as to make the conveyor belt 8 keep driving. This advances a timing of starting a printing based on a new print command, so that a printing speed sensed by a user is further improved, as compared with temporarily stopping the conveyor belt 8 after receiving the new print command.

In addition, during the period of time from when the new print command is received at the time point T2 in FIG. 7 to when the driving speed of the conveyor belt 8 reaches the normal speed V1 at the time point T3 in FIG. 7, a paper feeding is temporarily stopped (see S26 in FIG. 5). This prevents occurrence of a paper jam and a printing failure in performing a printing based on the new print command.

In S12, the desired speed determiner 70 according to the first embodiment calculates the low-speed printing time X2 with respect to each of the predetermined different low speeds V2 (which correspond to five rotational speeds of the conveyor belt 8, namely, 10, 20, 30, 40, and 50 rpm). The desired speed determiner 70*a* determines the desired speed to be the low speed V2 corresponding to the shortest one of the low-speed printing times X2 thus calculated (S13). However, this is not limitative. A value of the low speed V2 may be determined in various manners, as long as the low-speed printing time X2 is shorter than the normal-speed printing time X1. The desired speed determiner 70 may determine the low speed V2 in such a manner that the low-speed printing time X2 is equal to or longer than the normal-speed printing time X1.

The desired speed determiner 170 according to the second embodiment may determine the low speed V2 in such a manner that the total low-speed printing time is equal to or longer than the total normal-speed printing time. This elongates a total printing time, that is, a period of time from when the conveyor belt 8 starts driving in response to a print command to when a printing is completed, but shortens a period of time from when the conveyor belt 8 starts driving in response to a print command to when a paper P is placed onto the conveyor belt 8. Therefore, a printing speed sensed by a user is improved.

The desired speed determiner 170 according to the second embodiment determines the desired speed with reference to the table stored in the table memory 170*a*. However, this is not limitative. For example, it may be possible that, in the second embodiment, the table memory 170*a* is omitted and the desired speed determiner 170 determines the desired speed corresponding to a continuous printing number k without reference to the table.

The outer circumferential surface 8*a* of the conveyor belt 8 may not extend horizontally between the pick-up roller 11*c* and the peeling plate 14.

The speed sensor 18 may be omitted.

Although the ink-jet printer 101 described above is a line printer having the immovable heads 1, the present invention is applicable also to a serial printer having a reciprocating head. Moreover, in the above-described embodiments, the present invention is applied to the ink-jet printer 101 having the ink-jet head 1 that ejects ink droplets to a paper P. However, the present invention is applicable to other kinds of recording apparatuses such as a printer including a thermal head that thermally transfers ink to a paper P.

Applications of the present invention are not limited to a printer. The present invention is applicable to facsimile machines, copying machine, and other various recording apparatuses.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a conveyor mechanism including a plurality of rollers, an endless conveyor belt that is stretched between the rollers and has an outer circumferential surface for a recording medium to be placed thereon, and a driver that drives the conveyor belt;

a placer that places the recording medium onto the outer circumferential surface of the conveyor belt;

a recording head that records an image on the recording medium being conveyed by the conveyor mechanism;

a controller that controls the conveyor mechanism, the placer, and the recording head; and a table memory, wherein:

the controller determines a desired speed, which is a desired value of a driving speed of the conveyor belt during a recording, to be either one of a predetermined first speed and a second speed lower than the first speed;

the controller controls the conveyor mechanism so as to make the conveyor belt start driving and drive constantly at the desired speed, controls the placer so as to make the recording medium placed onto the outer circumferential surface of the conveyor belt after a driving speed of the conveyor belt reaches the desired speed, and controls the recording head so as to make an image recorded on the recording medium while the recording medium is being conveyed by the conveyor belt driven constantly at the desired speed;

the controller determines the desired speed for a first recording medium to be recorded based on a record command, to be the second speed;

the controller controls the recording head for a recording at the first speed after controlling the recording head for a recording at the second speed without stopping the conveyor mechanism;

in a continuous recording with a continuous recording number equal to or smaller than q (which represents a predetermined positive integer), the controller determines the desired speed for a first recording medium to be the second speed;

the table memory stores therein a table representing a plurality of different continuous recording numbers and desired speeds corresponding to the respective continuous recording numbers; and the controller determines the desired speed with reference to the table stored in the table memory.

2. The recording apparatus according to claim 1, wherein, in a continuous recording with a continuous recording number equal to or smaller than q, the controller determines the desired speed for all of recording media to be continuously recorded, to be the second speed.

3. The recording apparatus according to claim 1, wherein, in a continuous recording with a continuous recording number greater than q, the controller determines the desired speed for a first recording medium to be the first speed.

4. The recording apparatus according to claim 3, wherein, in a continuous recording with a continuous recording number greater than q, the controller determines the desired speed for all of recording media to be continuously recorded, to be the first speed.

5. The recording apparatus according to claim 1, wherein the controller determines the second speed in such a manner that a total second-speed recording time is shorter than a total first-speed recording time, the total second-speed recording time being a period of time from when the conveyor belt starts driving to when a recording on a final recording medium is completed in a state where the desired speed for all of recording media to be continuously recorded is determined to be the second speed, the total first-speed recording time being a period of time from when the conveyor belt starts driving to when a recording on a final recording medium is completed in a state where the desired speed for all of recording media to be continuously recorded is determined to be the first speed.

6. The recording apparatus according to claim 1, further comprising a sensor that detects a driving speed of the conveyor belt.

7. The recording apparatus according to claim 6, wherein the controller controls the placer so as to make the recording medium placed onto the outer circumferential surface of the conveyor belt after a speed detected by the sensor reaches the desired speed.

8. The recording apparatus according to claim 1, wherein the recording head is an inkjet head.

9. The recording apparatus according to claim 1, wherein the outer circumferential surface of the conveyor belt extends horizontally between the placer and a peeler that peels the recording medium from the outer circumferential surface of the conveyor belt.

10. A recording apparatus comprising:

a conveyor mechanism including a plurality of rollers, an endless conveyor belt that is stretched between the rollers and has an outer circumferential surface for a recording medium to be placed thereon, and a driver that drives the conveyor belt;

a placer that places the recording medium onto the outer circumferential surface of the conveyor belt;

a recording head that records an image on the recording medium being conveyed by the conveyor mechanism; and a controller that controls the conveyor mechanism, the placer, and the recording head, wherein:

the controller determines a desired speed, which is a desired value of a driving speed of the conveyor belt during a recording, to be either one of a predetermined first speed and a second speed lower than the first speed;

the controller controls the conveyor mechanism so as to make the conveyor belt start driving and drive constantly at the desired speed, controls the placer so as to make the recording medium placed onto the outer circumferential surface of the conveyor belt after a driving speed of the conveyor belt reaches the desired speed, and controls the recording head so as to make an image recorded on the recording medium while the recording medium is being conveyed by the conveyor belt driven constantly at the desired speed;

the controller determines the desired speed for a first recording medium to be recorded based on a record command, to be the second speed;

the controller controls the recording head for a recording at the first speed after controlling the recording head for a recording at the second speed without stopping the conveyor mechanism;

in a continuous recording with a continuous recording number equal to or smaller than q which represents a predetermined positive integer, the controller determines the desired speed for a first recording medium to be the second speed;

when, in receiving a new record command before completing a recording at the second speed as the desired speed, a sum of a recording number n (which represents a positive integer) included in the new record command and the number of unrecorded recording media involved in a previous recording command is greater than q, the controller switches the desired speed from the second speed to the first speed, and controls the conveyor mechanism so as to make the conveyor belt keep driving during a period of time from when the new record command is received to when a driving speed of the conveyor belt reaches the desired speed based on the new record command; and the recording number n is the number of recording media to be continuously recorded based on the record command.

11. The recording apparatus according to claim 10, wherein the controller controls the placer so as to prevent the recording medium from being placed onto the outer circumferential surface of the conveyor belt during a period of time from when the new record command is received to when the driving speed of the conveyor belt reaches the desired speed based on the new record command.

12. A recording apparatus comprising:

a conveyor mechanism including a plurality of rollers, an endless conveyor belt that is stretched between the rollers and has an outer circumferential surface for a recording medium to be placed thereon, and a driver that drives the conveyor belt;

a placer that places the recording medium onto the outer circumferential surface of the conveyor belt;

a recording head that records an image on the recording medium being conveyed by the conveyor mechanism; and a controller that controls the conveyor mechanism, the placer, and the recording head, wherein:

the controller determines a desired speed, which is a desired value of a driving speed of the conveyor belt during a recording, to be either one of a predetermined first speed and a second speed lower than the first speed;

the controller controls the conveyor mechanism so as to make the conveyor belt start driving and drive constantly at the desired speed, controls the placer so as to make the recording medium placed onto the outer circumferential surface of the conveyor belt after a driving speed of the conveyor belt reaches the desired speed, and controls the recording head so as to make an image recorded on the recording medium while the recording medium is being conveyed by the conveyor belt driven constantly at the desired speed;

the controller determines the desired speed for a first recording medium to be recorded based on a record command, to be the second speed;

the controller controls the recording head for a recording at the first speed after controlling the recording head for a recording at the second speed without stopping the conveyor mechanism;

in a continuous recording with a continuous recording number equal to or smaller than q which represents a predetermined positive integer, the controller determines the desired speed for a first recording medium to be the second speed; and the controller receives an additional record command while a recording at the second speed as the desired speed is performed, and when the continuous recording number regarding the additional record command is larger than q, the controller performs a control so as to switch the desired speed to the first speed when a recording based on a previous record command is completed, for the purpose of achieving a continuous recording.

* * * * *